United States Patent [19]

Greaves

[11] 3,990,203

[45] Nov. 9, 1976

[54] INSULATED CERAMIC FIBER PANELS FOR PORTABLE HIGH TEMPERATURE CHAMBERS

[76] Inventor: James R. Greaves, 870 S. East St., Anaheim, Calif. 92805

[22] Filed: Mar. 29, 1976

[21] Appl. No.: 671,402

[52] U.S. Cl. ..... 52/227; 52/262; 52/400; 52/506; 52/584; 52/624; 110/1 A; 428/99

[51] Int. Cl.[2] ..... E04C 3/10; F27D 1/00

[58] Field of Search ..... 110/1 A, 99 R, 99 A; 52/227, 262, 400, 584, 624, 487, 741, 506; 432/252; 428/99

[56] References Cited

UNITED STATES PATENTS

| | | | |
|---|---|---|---|
| 1,422,857 | 7/1922 | Haynsworth | 52/262 |
| 2,317,451 | 4/1943 | Giles | 52/601 |
| 2,349,700 | 5/1944 | Boyd | 52/487 X |
| 2,476,501 | 7/1949 | Maniscalo | 52/262 |
| 2,664,837 | 1/1954 | Banck | 110/99 R |
| 2,860,176 | 11/1958 | Lindgren | 52/584 X |
| 3,665,870 | 5/1972 | Lewicki | 110/99 R X |
| 3,819,468 | 6/1974 | Sauder et al. | 52/270 |
| 3,832,815 | 9/1974 | Balaz et al. | 52/404 X |
| 3,854,262 | 12/1974 | Brady | 52/404 |
| 3,940,244 | 2/1976 | Sauder et al. | 110/1 A |

*Primary Examiner*—Alfred C. Perham
*Attorney, Agent, or Firm*—Philip M. Hinderstein

[57] ABSTRACT

There is disclosed a ceramic fiber panel for forming the walls and ceilings of a high temperature chamber, such panels being self-supporting and interlocking for the construction of portable high temperature chambers without the reliance upon furnace walls for attachment or support. Each panel is formed from a plurality of strips of insulating ceramic fiber material positioned in side-by-side, parallel relationship and compressed, with the strips of all wall panels positioned vertically so as to be held together by the natural interlocking of adjacent fibers.

9 Claims, 8 Drawing Figures

FIG. 1.
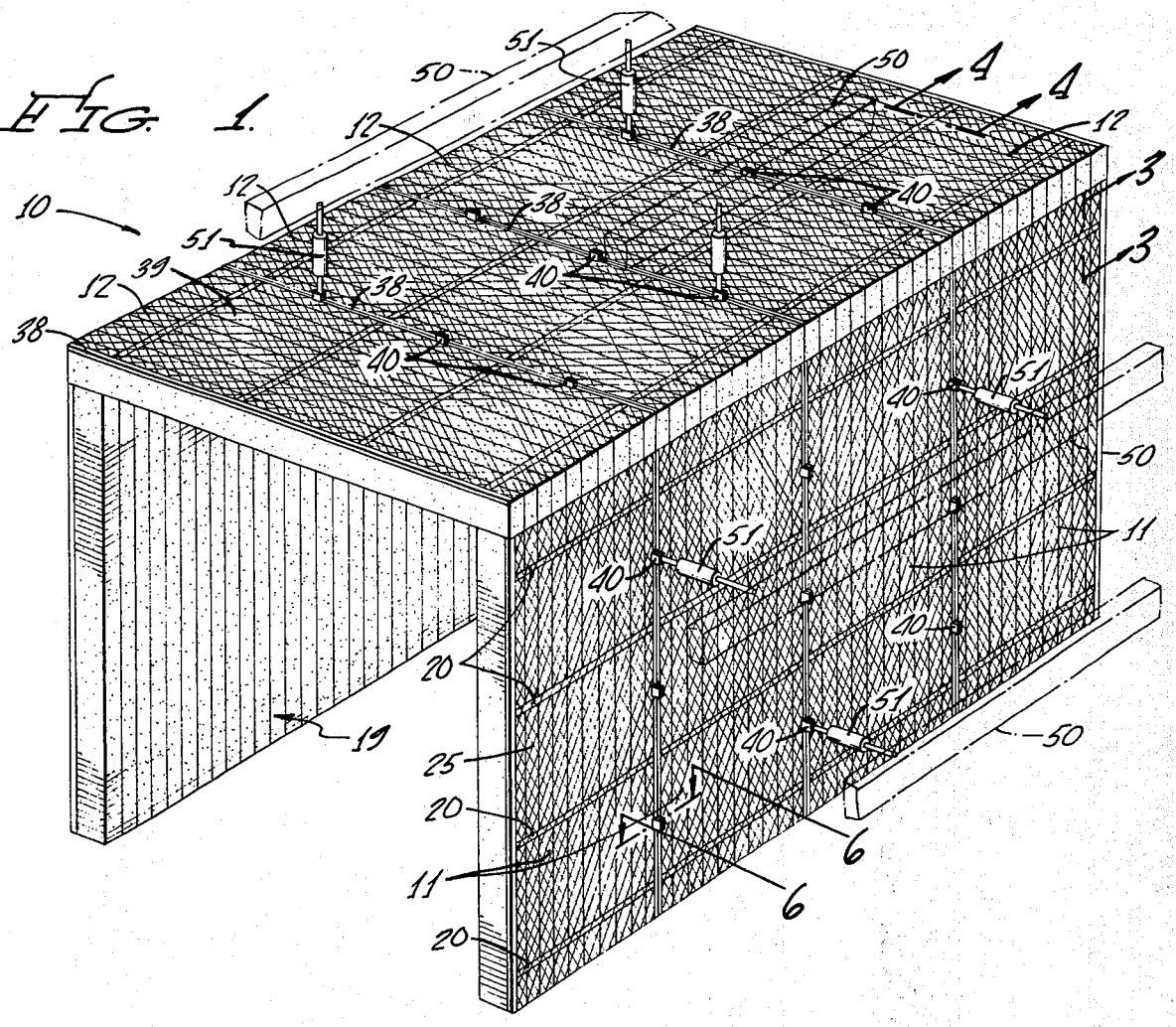
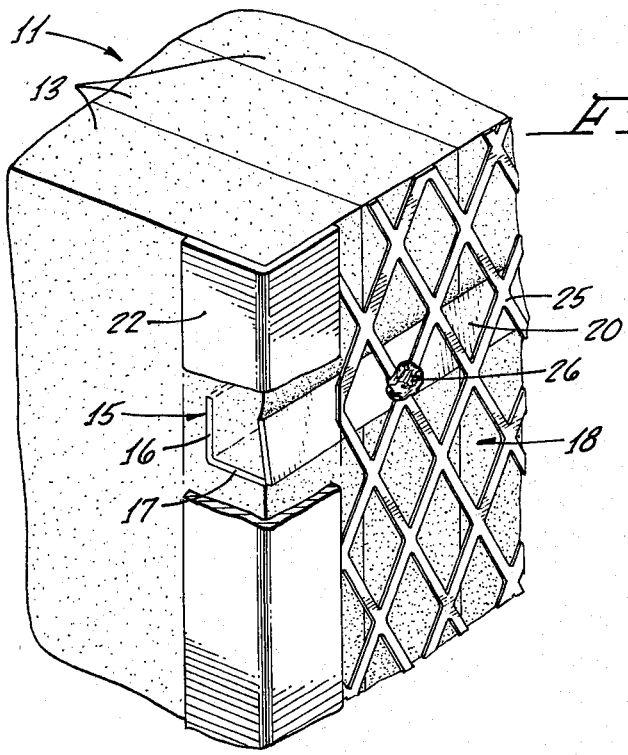
FIG. 2.
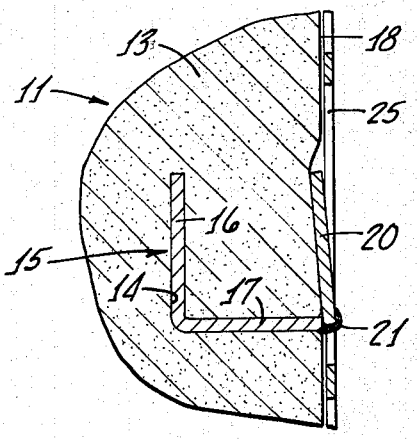
FIG. 3.

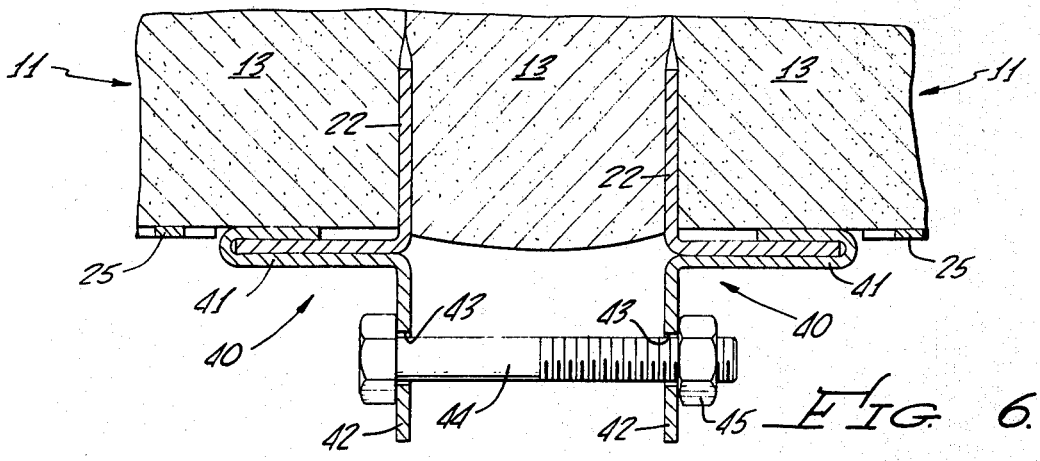
FIG. 6.
FIG. 5.
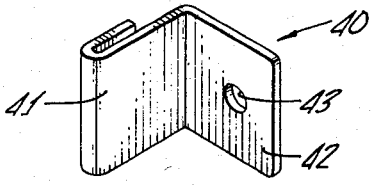
FIG. 8.
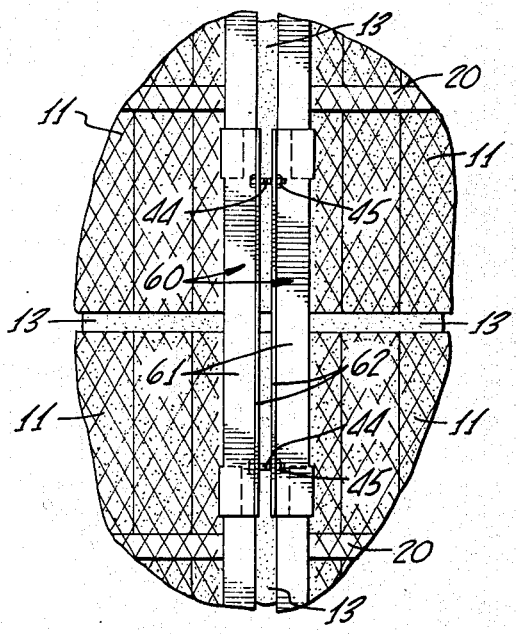
FIG. 7.
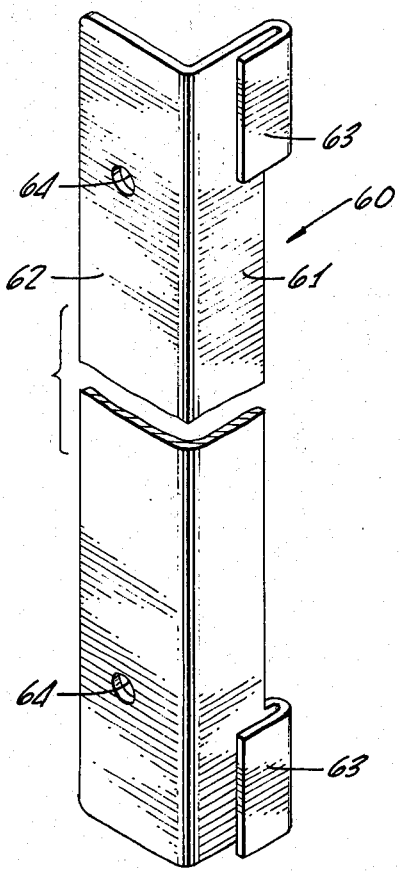
FIG. 4.
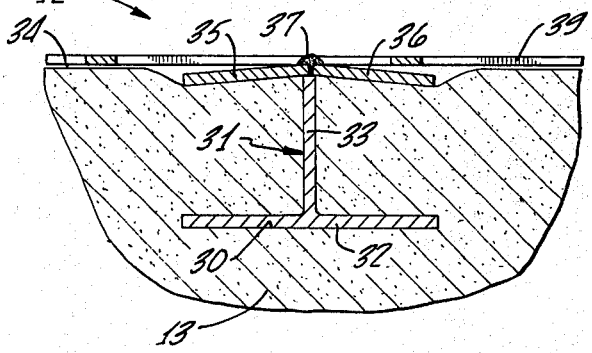

INSULATED CERAMIC FIBER PANELS FOR PORTABLE HIGH TEMPERATURE CHAMBERS

BACKGROUND OF THE INVENTION

1. Field of the Invention

The present invention relates to ceramic fiber panels for the construction of portable high temperature chambers and, more particularly, to a method and apparatus for the building of portable high temperature chambers, furnaces and kilns which does not rely upon furnace walls for attachment and support but rather forms its own roof and walls when fastened or clamped together.

2. Description of the Prior Art

Heat treating furnaces, ceramic kilns, brick kilns, and the like were initially lined with dense fireclay brick since it was the only material available that would readily withstand the high heats, in excess of 2,000° F., generated in such furnaces. When insulating fire brick was developed in the 1930's, it replaced fireclay brick as the lining for furnaces to take advantage of the lighter weight and lower thermal conductivity of this material. In the 1960's, insulating fire brick was largely replaced with a ceramic fiber material made of alumina-silica fibers matted into a blanket form. Such blankets are formed in a variety of widths and thicknesses and sold in long rolls. Ceramic fibers in blanket form are marketed under the trade names Kaowool by Babcock and Wilcox Company, Cerablanket or Cerafelt by Johns-Mansville Company and Durablanket or Fiberfrax by Carborundum Corporation.

Compared to brick, ceramic fiber provides twice the sound and heat capabilities of insulating fire brick and four times the heat and sound insulating capabilities of hard brick, at one-tenth the weight. It also will not retain or absorb heat and has better shock characteristics. Besides reducing the amount of fuel required to fire a furnace using a ceramic fiber blanket, the lower heat storage means that the furnace can be brought up to temperature faster and cooled faster. This allows faster cycling and quicker access to a kiln if it must be brought down for repairs.

Conventionally, since ceramic fiber comes in rolls, it is applied to the furnace ceiling and walls as a blanket, in multiple layers, by impaling upon metal studs welded in a precise pattern to the furnace walls. Unfortunately, these studs limit the temperature range of the furnace since they can withstand much less heat than the ceramic fiber material itself. Furthermore, the method of manufacture of the fiber blankets positions the individual fiber strands in parallel planes and the above method positions these parallel planes parallel to the walls of the furnace. In use, the high heat in the furnace causes shrinkage of the strands and this opens gaps at the ends of the blankets, which gaps must be periodically repacked after regular periods of use.

To overcome the above problems, it has been proposed to cut the ceramic fiber into strips and to position a plurality of strips in side-by-side, parallel relationship to form a module. The individual ceramic fiber strips are typically impaled upon stainless wire or steel rods thereby encapsulating the entire unit against a steel shell. For examples of this later construction, reference should be had to U.S. Pat. Nos. 3,819,468; 3,832,815; and 3,854,262.

While these later constructions eliminate the temperature limiting and shrinkage problems of the former method, all of the later methods require the lining to be bolted or welded to the metal furnace walls. Therefore, the procedure for building a new furnace or relining an old furnace is time consuming and expensive, requiring special tools for attaching the modules to the walls, such as the tool described in U.S. Pat. No. 3,706,870.

SUMMARY OF THE INVENTION

According to the present invention, there is provided ceramic fiber panels for the construction of high temperature chambers, furnaces, and kilns which solves the problems discussed above in a manner unknown heretofore. The present panels form both the interior and exterior of a high temperature furnace or chamber. Accordingly, the present invention has particular application for the manufacture of portable high temperature chambers since the panels do not rely upon furnace walls for attachment and support but rather, they form their own roof and walls when fastened or clamped together. With the present panels, a furnace may be constructed simply and inexpensively, with a substantial reduction in the time necessary for manufacturing a new furnace or relining an existing furnace.

Briefly, a ceramic fiber panel for forming the walls of a high temperature chamber and having a hot face which is adapted to face the interior of the chamber and a cold face comprises a plurality of strips of insulating ceramic fiber material positioned in side-by-side, parallel relationship; an L-shaped tension bar extending perpendicularly through the strips, one of the legs of the tension bar being parallel to and spaced from the cold face of the panel, the other of the legs of the tension bar being perpendicular to the cold face and extending from the one leg to the cold face; a flat crimp bar extending along the cold face of the strip, one side edge of the crimp bar being connected to the side edge of the other leg of the tension bar, at the cold face, the crimp bar extending at an acute angle relative to the other leg of the tension bar so as to crimp a portion of each fiber strip between the crimp bar and the one leg of the tension bar whereby the tension bar and the crimp bar fully support the strips; and a pair of L-shaped support bars positioned along the outermost edges of the outermost strips of each panel, perpendicular to the tension and crimp bars, the opposite ends of the tension bar being connected to the support bars, the strips being compressed laterally, the compressive forces being resisted by the tension bar. A wall for a high temperature chamber is formed from a plurality of such panels, all of the panels having the strips of ceramic fiber material in a vertical position, the panels being clamped together by adjustable clamping brackets whereby the wall panels become self-supporting.

A ceramic fiber panel for forming the ceiling of a high temperature chamber is smilar to the panels which form the walls of the chamber, except that the tension bar is T-shaped, having a third leg connected to the intersection between the one and other legs thereof and extending coplanar with the one leg, parallel to and spaced from the cold face of the panel, the opposite ends of the third leg of the tension bar being connected to the support bars, and the panel includes a second crimp bar extending along the cold face of the strips, one side edge of the second crimp bar being connected to the side edge of the other leg of the tension bar, the second crimp bar extending at an acute angle relative to the other leg of the tension bar so as to crimp a portion of each fiber strip between the second crimp bar and the third leg of the tension bar. The ceiling for a high temperature chamber is formed from a plurality of such ceiling panels which are clamped together using adjustable clamping brackets.

OBJECTS

It is therefore an object of the present invention to provide ceramic fiber panels fo the construction of portable high temperature chambers.

It is a further object of the present invention to provide a method and apparatus for the building of portable high temperature chambers, furnaces and kilns which does not rely upon furnace walls for attachment and support but rather forms its own roof and walls when fastened or clamped together.

It is a still further object of the present invention to provide ceramic fiber panels for the construction of portable high temperature chambers which utilize a plurality of ceramic fiber strips positioned in side-by-side, parallel relationship to form a module.

It is another object of the present invention to provide ceramic fiber panels which permit a furnace to be constructed rapidly, simply, and inexpensively.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like or corresponding parts in the several figures and wherein:

BRIEF DESCRIPTION OF THE DRAWINGS

FIG. 1 is a perspective view of a portable high temperature chamber made from ceramic fiber panels constructed in accordance with the teachings of the present invention;

FIG. 2 is an enlarged perspective view of one corner of one of the wall panels of FIG. 1;

FIGS. 3 and 4 are enlarged sectional views taken along the lines 3—3 and 4—4, respectively, in FIG. 1;

FIG. 5 is a perspective view of a clamping bracket usable in clamping together adjacent panels;

FIG. 6 is an enlarged sectional view taken along the line 6—6 in FIG. 1;

FIG. 7 is a perspective view of another clamping bracket usable for interconncting four adjacent panels; and FIG. 8 is a front elevation view of four intersecting wall penels showing the use of the clamping bracket of FIG. 7.

DESCRIPTION OF THE PREFERRED EMBODIMENT

Referring now to the drawings and, more particularly, to FIG. 1 thereof, there is shown a portable high temperature chamber, furnace, or kiln, generally designated 10, formed from wall and ceiling panels 11 and 12, respectively, constructed in accordance with the teachings of the present invention. More specifically, and with reference to FIGS. 2 and 3, each wall panel 11 is formed from a plurality of strips 13 of insulating ceramic fiber material positioned in side-by-side, parallel relationship. Strips 13 are formed from a ceramic fiber blanket by cutting the blanket into strips of varying lengths and widths, depending upon the size of panel 11 to be constructed. Panels 11 may be of any width, length, and thickness, depending upon the application for which it is intended. Each strip 13 is then notched or cut at predetermined intervals along one side thereof in the shape of an "L", as shown at 14 in FIG. 3. All of the notches 14 in all of the strips 13 are positioned in the same location so that when strips 13 are positioned in side-by-side, parallel relationship, all of the notches 14 are aligned. The sides of strips 13 having notches 14 therein form the cold face 18 of each panel 11, the other side forming the hot face 19.

After panels 13 are formed and notched, an L-shaped tension bar 15 is extended perpendicularly through strips 13, through notches 14 therein. As shown most clearly in FIG. 3, one of the legs 16 of tension bar 15 is parallel to and spaced from cold face 18 of panel 11 and the other leg 17 of tension bar 15 is perpendicular to cold face 18, extending from leg 16 to cold face 18. Tension bars 15 would normally be spaced vertically no less than six inches from each other and no more than eighteen inches from each other.

Strips 13 are then placed on edge, with hot face 19 on a suitable support surface, and compressed laterally to a given density, as is known in the art. When compressed, the fibers tend to bind together and will not slide on each other because of the friction created by the interlocking fibers.

A flat crimp bar 20 is now extended along cold face 18 of strips 13, crimp bar 20 being positioned with one side edge thereof contacting the side edge of leg 17 of tension bar 15 at cold face 18. Crimp bar 20 is held at an acute angle relative to leg 17 of tension bar 15 so as to crimp a portion of each fiber strip 13 between crimp bar 20 and leg 16 of tension bar 15. Crimp bar 20 is then spot welded to leg 17, at a plurality of points along the length thereof, as shown at 21.

In order to prevent the expansion of strips 13 when released and to permit the attachment of adjacent panels 11 to each other, each panel 11 has a pair of L-shaped support bars 22 positioned along the outermost edges of the outermost strips 13 of each panel 11, perpendicular to tension bar 15 and crimp bar 20, the opposite ends of tension bar 15 and, optionally, crimp bar 20 being connected to support bars 22, such as by welding. Finally, each ceramic fiber panel 11 preferably has an expanded metal backing sheet 25, which is spot welded to crimp bar 20, at 26, to form a backing for panel 11. While backing sheet 25 may be made from sheet metal or many other materials, expanded metal is preferred since it adequately protects cold face 18 of each panel 11 while leaving the back open for air circulation which has the effect of cooling surface 18.

With reference now to FIGS. 1 and 4, each ceiling panel 12 is basically similar to each wall panel 11, except that after each strip 13 is formed, it has a "T" shaped notch or cut 30 placed therein for receipt of a tension bar 31. Tension bar 31 is T-shaped, having one leg 32 parallel to and spaced from the cold face 34 of panel 13 and a leg 33 extending from the center of leg 32 to cold face 34. Also in the case of panel 13, a pair of crimp bars 35 and 36 are utilized, positioned edge-to-edge, in contact with cold face 34 of panel 13. Crimp bars 35 and 36 are positioned at acute angles relative to leg 33 of tension bar 31 and spot welded at a plurality of points along the lengths thereof, at 37, to leg 33, at cold face 34. L-shaped support bars 38 are positioned along the outermost edges of the outermost strips of each panel 13 and an expanded metal backing sheet 39 may also be utilized.

Adjacent wall panels 11 and ceiling panels 12 may be clamped together utilizing clamping brackets 40, as shown in FIG. 5. Each clamping bracket 40 includes a U-shaped leg 41 having a space in between the sides thereof which is slightly greater than the thickness of the legs of support bars 22 and 38. Each bracket 40 also includes a leg 42 connected perpendicular to leg 41 and having a hole 43 therein. Clamping brackets 40 are connectable to support bars 22 and 38 as shown in FIG. 6. The legs of support bars 22 which extend along cold face 18 are extended between the sides of legs 41 so that with two brackets 40 connected to adjacent panels 11, legs 42 are parallel, with holes 43 aligned. A single strip 13 of insulating ceramic fiber material would normally be positioned between the outermost strips of each panel to provide good insulation therebetween. Thereafter, a bolt 44 may be positioned through aligned holes 43 in adjacent brackets 40 and connected with a nut 45. A similar procedure would be utilized to connect adjacent ceiling panels 12, as shown in FIG. 1.

This type of construction serves two purposes. First, tension bars 15 and 31 provide the support needed to suspend ceramic fiber strips 13 without metal being exposed to the extreme interior furnace temperatures. Secondly, crimp bars 20, 35 and 36 lock strips 13 to tension bars 15 and 31 and serve as heat sinks to provide a heat bleed-off of tension bars 15 and 31, thereby allowing the use of sheet steel or plain carbon steel rather than the use of expensive, high temperature alloys.

Each panel 11 and 12 is fully self-supporting. Accordingly, this type of construction for panels 11 and 12 completely eliminates the need for sheet metal furnace exteriors and, in fact, maintains cooler exteriors without the standard sheet metal covering or backing. The present design fully utilizes the unique property of the ceramic fiber which is that it will not slide upon itself. Thus, all wall panels 11 have the strips forming the furnace in a vertical position. Thus, strips 13 are held together by the natural interlocking of the fibers when they are held in compression.

Panels 11 and 12 would be manufactured in standard sizes. Roof panels 12 may be from twelve inches to thirty-six inches wide with a length to eight feet. For temperatures to 2,350° F., the thickness of panels 11 and 12 would be six inches. In the construction of a new kiln or furnace where panels 11 and 12 are to be used, all that may be required would be a frame of support panels, as shown in phantom at 50 in FIG. 1. Support beams would be set at intervals that do not interfere with the bolting of panels 11 and 12. An eye bolt, hanger strip or hanger rod 51 may be used to connect panels 11 and 12 to support beams 50.

Installation of panels 11 and 12 in a new kiln or furnace may be achieved simply and rapidly. The panels 11 which form a wall may be positioned in side-by-side relationship with hot faces 19 on a suitable support surface to permit cold faces 18 to be clamped together utilizing clamping brackets 40. Thereafter, the entire wall may be erected and connected to support beams 50 using hanger rods 51. The ceiling panels 12 may be clamped together in the same manner and lifted into position with the side edges supported by the walls. Hanger rods 51 may be used to support the centers of panels 12 from support beams 50. The number of supports required is dependent upon the span of each roof panel 12. A rule of thumb is that each roof panel 12 should be supported each 4 feet or an 8 foot wide kiln or furnace should have one center support.

Referring now to FIGS. 7 and 8, it is also possible to stack panels 11 or 12 end-to-end so as to form a wall or ceiling having a length greater than the length of an individual panel 11 or 12. For this purpose, a bracket 60 may be utilized, as shown in FIG. 7. Bracket 60 is an elongate, L-shaped member having legs 61 and 62, leg 61 having spaced tabs 63 made integral therewith and leg 62 having holes 64 therein. Two brackets 60 may be positioned as shown in FIG. 8 at the intersection of four wall panels 11. As mentioned previously, one strip 13 of ceramic fiber material would be positioned between each adjacent panel 11 to be used as a joint or compression seal. One bracket 60 is positioned so as to engage the vertically aligned support bars 22 of vertically spaced panels 11 and the other clamping bracket 60 is connected to the vertically aligned support bars 22 of the other pair of vertically spaced panels 11. Once so positioned, the holes 64 in adjacent legs 62 are aligned, permitting interconnection by means of bolts 44 and nuts 45. With the combination of brackets 40 and 60, any size furnace 10 may be formed from standard size panels 11 and 12.

It can therefore be seen that according to the present invention, there is provided ceramic fiber panels 11 and 12 for the construction of high temperature chambers, furnaces, and kilns which solves the problems discussed hereinbefore. Panels 11 and 12 form both the interior and exterior of a high temperature furnace or chamber. Accordingly, the present invention has particular application for the manufacture of portable high temperature chambers since panels 11 and 12 do not rely upon furnace walls for attachment and support but rather, they form their own roof and walls when fastened or clamped together. With panels 11 and 12, a furnace may be constructed simply and inexpensively, with a substantial reduction in the time necessary for manufacturing a new furnace or relining an existing furnace.

While the invention has been described with respect to the preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. A ceramic fiber panel for forming the walls of a high temperature chamber and having a hot face which is adapted to face the interior of said chamber and a cold face comprising:

a plurality of strips of insulating ceramic fiber material positioned in side-by-side, parallel relationship;

an L-shaped tension bar extending perpendicularly through said strips, one of the legs of said tension bar being parallel to and spaced from said cold face of said panel, the other of the legs of said tension bar being perpendicular to said cold face and extending from said one leg to said cold face;

a flat crimp bar extending along said cold face of said strips, one side edge of said crimp bar being connected to the side edge of said other leg of said tension bar, at said cold face, said crimp bar extending at an acute angle relative to said other leg of said tension bar so as to crimp a portion of each fiber strip between said crimp bar and said one leg of said tension bar whereby said tension bar and said crimp bar fully support said strips; and a pair of L-shaped support bars positioned along the outermost edges of the outermost strips of each panel, perpendicular to said tension and crimp bars, the opposite ends of said tension bar being connected to said support bars, said strips being compressed laterally, the compressive forces being resisted by said tension bar.

2. A wall for a high temperature chamber comprising:

a plurality of ceramic fiber panels according to claim 1, all of said panels having the strips of ceramic fiber material in a vertical position with said one leg of said tension bar extending upwardly from said other leg thereof; and means for clamping together adjacent panels whereby said wall is self-supporting.

3. A wall for a high temperature chamber according to claim 2 wherein said means for clamping together adjacent panels comprises:

a plurality of clamping brackets, each of said clamping brackets being adjustably connectable to said support bars, on opposite sides of each panel; and means for interconnecting adjacent clamping brackets.

4. A wall according to claim 3 wherein each of said clamping brackets comprises:

a U-shaped leg, the leg of said support bars which is parallel to said tension and crimp bars being extendable into said U-shaped leg of said clamping brackets; and a flat leg connected to said U-shaped leg, perpendicular thereto, so as to extend parallel to said strips of insulating ceramic fiber material in use, said flat leg having a hole therein, the flat legs of adjacent clamping brackets being parallel with said holes therein aligned; and wherein each of said clamping brackets interconnecting means comprises:

a bolt extendable through said aligned holes in said clamping brackets.

5. A ceramic fiber panel according to claim 1 further comprising:

a plurality of L-sahped tension bars extending perpendicularly through said strips in parallel, spaced relationship; and a plurality of crimp bars connected to the side edges of said tension bars, the opposite ends of said tension and crimp bars being connected to said support bars.

6. A ceramic fiber panel according to claim 1 for forming the ceiling of a high temperature chamber wherein said tension bar has a third leg connected to the intersection between said one and said other legs and extending coplanar with said one leg, parallel to and spaced from said cold face of said panel and the opposite ends of said third leg of said tension bar being connected to said support bars, and further comprising:

a second, flat crimp bar extending along said cold face of said strips, one side edge of said second crimp bar being connected to said side edge of said other leg of said tension bar, said second crimp bar extending at an acute angle relative to said other leg of said tension bar so as to crimp a portion of each fiber strip between said second crimp bar and said third leg of said tension bar.

7. A wall and a ceiling for a high temperature chamber comprising:

a plurality of wall and ceiling ceramic fiber panels according to claim 6, all of said wall panels having the strips of ceramic fiber material in a vertical position with said one leg of said tension bar extending upwardly from said other leg thereof;

means for clamping together adjacent wall panels whereby said wall is self-supporting; and means for clamping together adjacent ceiling panels whereby said ceiling is self-supporting.

8. A high temperature chamber according to claim 7 wherein said means for clamping together adjacent wall and ceiling panels comprises:

a plurality of clamping brackets, each of said clamping brackets being adjustably connectable to said support bars, on opposite sides of each panel; and means for interconnecting adjacent clamping brackets.

9. A method of forming the walls and ceiling of a high temperature chamber comprising:

providing a plurality of wall and ceiling panels according to claim 6;

positioning the panels for each wall section in side-by-side, coplanar relationship with all of the panels having the strips of ceramic fiber material in a vertical position with said one leg of said tension bar extending upwardly from said other leg thereof;

clamping together adjacent panels of each wall whereby each wall is self-supporting;

positioning the ceiling panels in side-by-side, coplanar relationship with all of the strips of ceramic fiber material of all panels parallel;

clamping together adjacent ceiling panels; and resting said ceiling panels on said wall panels.

* * * * *